US007214897B2

(12) United States Patent
Chuang

(10) Patent No.: US 7,214,897 B2
(45) Date of Patent: May 8, 2007

(54) ILLUMINATED KEYBOARD WITH ILLUMINATED PATTERNS DISPLAYED ON TOP SURFACE OF KEYBOARD

(75) Inventor: Cheng Hua Chuang, Taipei (TW)

(73) Assignee: Behavior Tech Computer Corp., Taipei (TW)

( * ) Notice: Subject to any disclaimer, the term of this patent is extended or adjusted under 35 U.S.C. 154(b) by 42 days.

(21) Appl. No.: 11/049,170

(22) Filed: Feb. 3, 2005

(65) Prior Publication Data

US 2005/0231933 A1 Oct. 20, 2005

(30) Foreign Application Priority Data

Apr. 19, 2004 (TW) ..... 93206036 U

(51) Int. Cl.
*F21V 9/16* (2006.01)

(52) U.S. Cl. ..... 200/317; 200/314; 400/711; 400/716; 84/13; 84/464 R; 84/464 A; 84/477 R; 84/720; 84/423 R; 84/744; 84/745; 362/84

(58) Field of Classification Search ..... 362/84; 200/314, 317; 400/711, 716; 84/13, 464 R, 84/464 A, 719, 720, 744, 745, 423 R, 477 R
See application file for complete search history.

(56) References Cited

U.S. PATENT DOCUMENTS

2002/0114153 A1* 8/2002 Chan et al. ..... 362/85
2003/0043120 A1* 3/2003 Han ..... 345/168
2003/0112620 A1* 6/2003 Prindle ..... 362/84
2005/0073829 A1* 4/2005 Burger et al. ..... 362/84

* cited by examiner

*Primary Examiner*—Renee Luebke
*Assistant Examiner*—Mary Zettl
(74) *Attorney, Agent, or Firm*—Rosenberg, Klein & Lee

(57) ABSTRACT

An illuminated keyboard with illuminated figures being formed on the top surface of the keyboard including: a top cover, a bottom cover, a plurality of keys and an electroluminescent board. The top cover accommodates the keys and is combined with the bottom cover. The electroluminescent board is installed between the top cover and the bottom cover. The electroluminescent board includes at least one figured pattern to be displayed on a top surface of the keyboard on the top cover when the electroluminescent board is electrified to give light.

8 Claims, 5 Drawing Sheets

ILLUMINATED KEYBOARD WITH ILLUMINATED PATTERNS DISPLAYED ON TOP SURFACE OF KEYBOARD

The present invention relates to an illuminated keyboard, particularly a user-friendly illuminated keyboard with illuminated patterns being displayed on the top surface of the keyboard.

BACKGROUND OF THE INVENTION

The conventional illuminated keyboard uses an electroluminescent light as a continuous light source in dark environments. An electroluminescent board is installed inside conventional illuminated keyboards, such that when power is supplied, the electroluminescent board is illuminated to emit light onto the keyboard. However, the main purpose of the electroluminescent board is to emit a continuous illuminated light in a dark environment. The user of such an illuminated keyboard is only provided with the feeling of a cold-hearted device.

In view of the above shortcoming in the conventional illuminated keyboard, the present invention provides an illuminated keyboard that invokes a user-friendly feeling by displaying figured patterns on its top using the light projected from the electroluminescent board, in addition to its regular function of providing an illuminated light in a dark environment.

SUMMARY OF THE INVENTION

It is the first objective of this invention to provide an illuminated keyboard with illuminated patterns displayed on top of the keyboard.

It is a second objective of this invention to provide an illuminated keyboard with contrasted illuminated patterns being displayed on top of the keyboard.

It is a third objective of this invention to provide an illuminated keyboard that, in addition to enabling continued operation even in a dark environment, it has enhanced user-friendliness by displaying figured patterns on top of the keyboard.

To achieve the above objectives, the present invention provides an illuminated keyboard with illuminated patterns on top of the keyboard that includes a plurality of keys, a top cover accommodating the keys, a bottom cover that is combined with the top cover, and an electroluminescent board installed between the top cover and the bottom cover. The electroluminescent board includes patterns that can be illuminated and displayed on top of the keyboard.

BRIEF DESCRIPTION OF THE DRAWINGS

The above objects and advantages of the present invention will become more apparent with reference to the appended drawings, wherein.

DETAILED DESCRIPTION OF THE INVENTION

Figure 1:
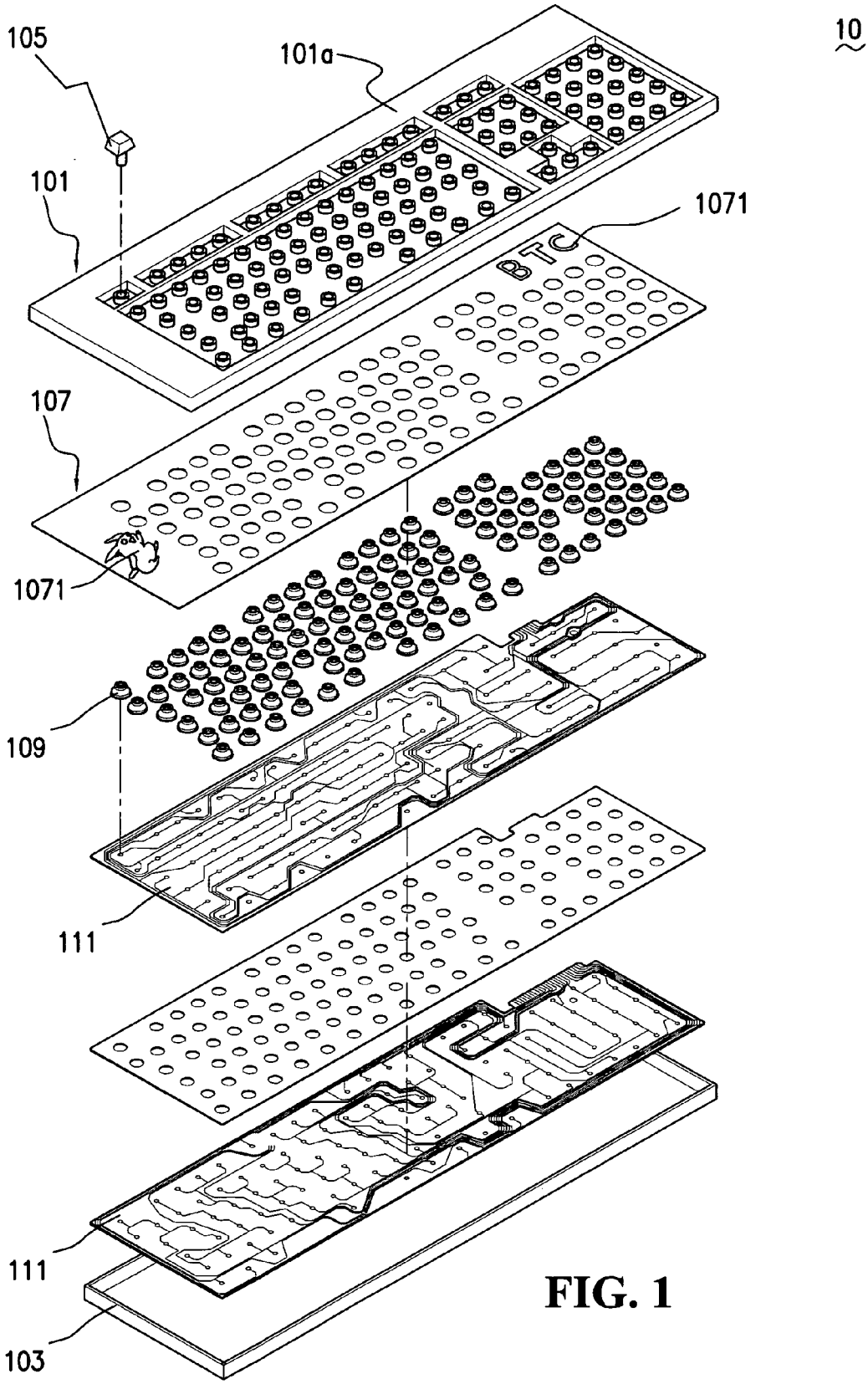
FIG. 1 is an exploded view of the present invention of the keyboard with illuminated patterns displayed on top of the keyboard.

FIG. 1 shows an exploded view of the illuminated keyboard of the present invention with patterns of figures being displayed on top of the keyboard. The illuminated keyboard 10 of the present invention includes at least a top cover 101, a bottom cover 103, a plurality of keys 105 and an electroluminescent board 107. In assembling the keyboard 10, the final step is to combine the top cover 101 with the bottom cover 103 to form a single unit. The space between the top cover 101 and the bottom cover 103 is used to accommodate the electroluminescent board 107 and related components, including a plurality of flexible members 109 and a membrane circuit board 111. To enable penetration of the electroluminescent light emitted from the electroluminescent board 107 through the top surface of keyboard 101*a*, the top cover 101 is preferably made of transparent materials. The keys 105 are installed on the top cover 101 and are preferably transparent to enable penetration of electroluminescent light being emitted from the electroluminescent board 107. The top surface of keyboard 101*a* encompasses an area which includes the area occupied by the keys 105, as well as other areas of the top cover 101 not occupied by the keys 105. Importantly, the main purpose of the top surface of keyboard 101*a* is to display a visual effect created by the electroluminescent light emitted from the electroluminescent board 107.

The electroluminescent board 107 is installed between the top cover 101 and the bottom cover 103. For example, the electroluminescent board 107 is installed on a bottom side of the top cover 101. The most important characteristic of the electroluminescent board 107 of the invention is its inclusion of at least one pattern of a figure 1071. The patterns 1071 may consist of one of the following: a cartoon figure, a series of text and digits, or a picture pattern.

Figure 2:
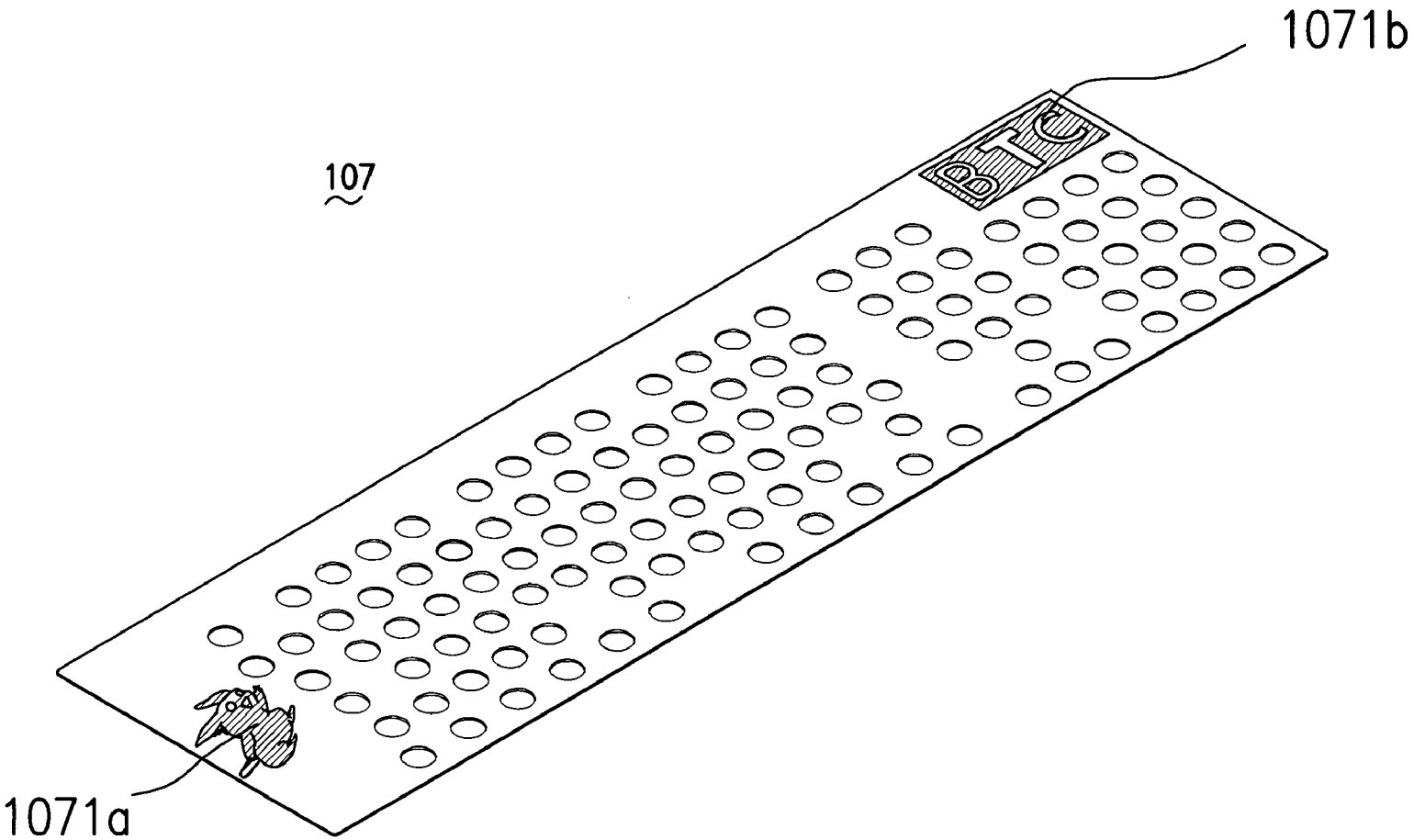
FIG. 2 is an illustration of a first embodiment of the electroluminescent board in the invention.

FIG. 2 shows a first embodiment of the electroluminescent board of the present invention. On the electroluminescent board 107 shown in FIG. 2, the pattern 1071*a* (shown in diagonal lines) is coated with electroluminescent material, to enable display of illuminated patterns when they are electrified. When the light of the pattern 1071*a* penetrates the top surface of keyboard 101*a*, the pattern 1071*a* is lit and displayed on the top surface of keyboard 101*a*. The pattern 1071*b* consists of a series of letters "BTC". The letters "BTC" themselves may not be electrified to give light. The remaining area (shown in diagonal lines) surrounding patterns 1071*b*, such as a rectangular zone from which the letters "BTC" are excluded, is coated with electroluminescent material. When the surrounding area is illuminated, the pattern 1071*b* is displayed on the top surface of keyboard 101*a* as a shadow on the surrounding area.

Figure 3:
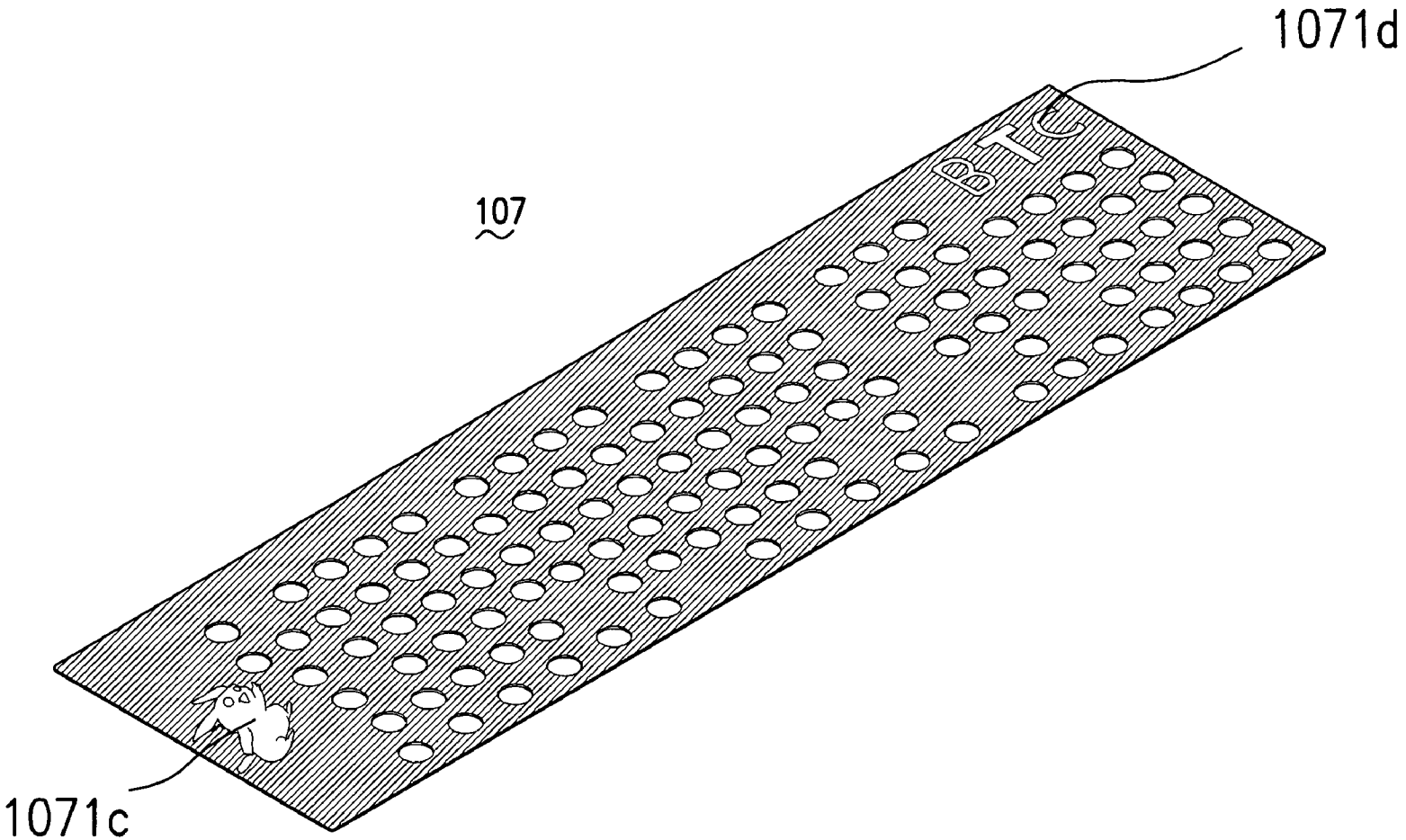
FIG. 3 is an illustration of a second embodiment of the electroluminescent board in the invention.

FIG. 3 shows a second embodiment of the electroluminescent board of the present invention. On the electroluminescent board 107 shown in FIG. 3, the patterns 1071*c*, 1071*d* are not capable of being illuminated, however, the other areas on the electroluminescent board 107 (shown at the diagonal lines) are coated with electroluminescent material. When the electroluminescent board 107 is electrified, most of the area on the top surface of keyboard 101*a* is illuminated thereby, whereby the figures 1071*c*, 1071*d* are displayed in shadow.

Figure 4:
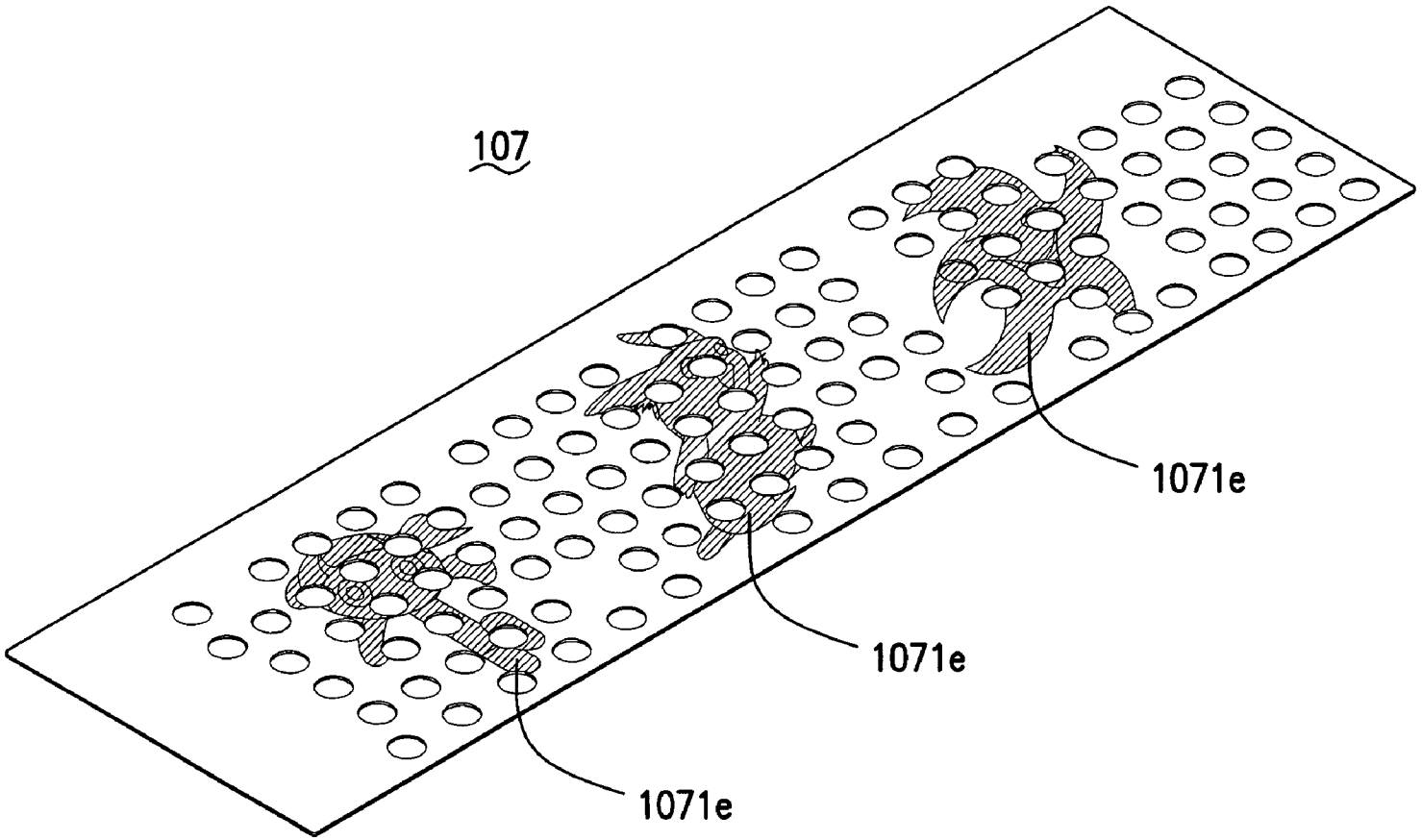
FIG. 4 is an illustration of a third embodiment of the electroluminescent board in the invention.

FIG. 4 shows a third embodiment of the electroluminescent board of the present invention. On the electrolumines cent board 107 shown in FIG. 4, the patterns 1071*e* (shown in diagonal lines) are coated directly on the electroluminescent board with electroluminescent material. The electroluminescent coating on the patterns 1071*e* is positioned on the surface that is occupied by keys 105. Thus, when the patterns 1071*e* on the electroluminescent board 107 are electrified to give light, the top surface of keyboard 101*a* where the keys 105 are located displays an illuminated image of the patterns 1071*e*.

Figure 5:
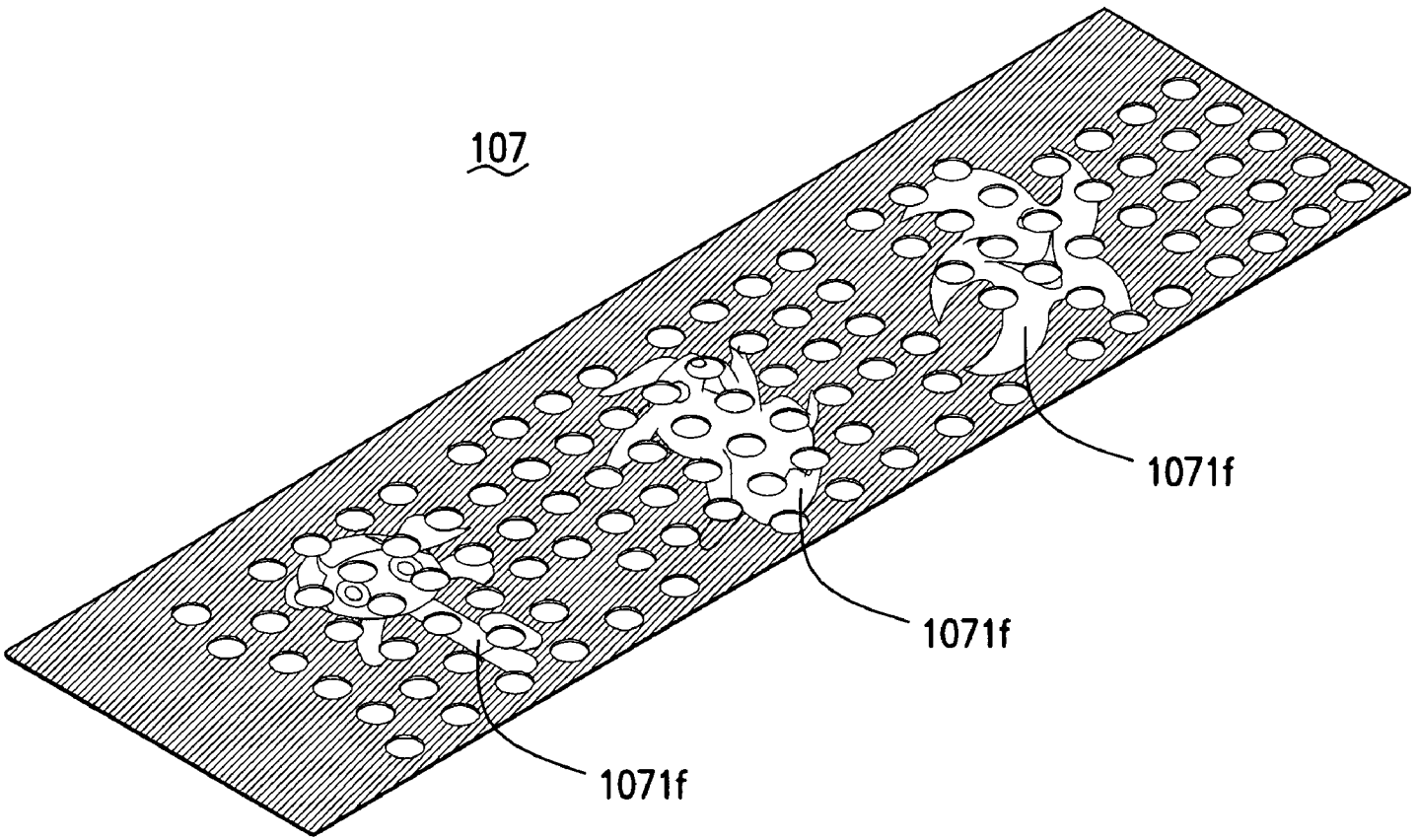
FIG. 5 is an illustration of a fourth embodiment of the electroluminescent board in the invention.

FIG. 5 shows a fourth embodiment of the electroluminescent board of the present invention. On the electroluminescent board 107 shown in FIG. 5, patterns 1071*f* themselves are not capable of being illuminated, but are formed on the electroluminescent board 107. Instead, the area surrounding the patterns 1071*f* is coated with electroluminescent material. The marked area having diagonal lines designates the area that is occupied by keys 105. When the electroluminescent board 107 is electrified to give light, the marked area having diagonal lines is illuminated, thereby displaying shadows of the patterns 1071*f*, such that they are visible on keys 105.

Using the illuminated electroluminescent board 107, the present invention can be operated even in a dark environment by displaying an illuminated image of the patterns on the top surface of the keyboard, providing the user with a feeling of variety in the illuminated figures being displayed on the keyboard, as well as visual enjoyment.

It is to be understood that variations or modifications may be made to the present invention by one skilled in the art without departing from the spirit and intent of the invention, and that all variations and modifications so made are encompassed in the following claims.

What is claimed is:

1. An illuminated keyboard comprising:

a plurality of keys;

a top cover accommodating the keys;

a bottom cover combined with the top cover; and an electroluminescent board disposed under the keys, wherein the electroluminescent board includes patterns of electroluminescent material disposed on a top surface thereof defining indicia of at least one figure thereon, the figure being optically transmitted to a top surface of the top cover of the keyboard adjacent the keys when the electroluminescent board is electrified to give light.

2. The illuminated keyboard as claimed in claim 1, wherein the indicia is formed of electroluminescent material and capable of being electrified to give light.

3. The illuminated keyboard as claimed in claim 1, wherein the indicia are not capable of being illuminated, while an area surrounding the indicia is formed of the electroluminescent material and is capable of being electrified to give light.

4. The illuminated keyboard as claimed in claim 1, wherein the indicia is a cartoon figure.

5. The illuminated keyboard as claimed in claim 1, wherein the indicia are a series of digital signs.

6. The illuminated keyboard as claimed in claim 1, wherein the keys are transparent.

7. The illuminated keyboard as claimed in claim 1, wherein the top surface of the top cover of the keyboard is transparent.

8. The illuminated keyboard as claimed in claim 1, wherein the top cover is transparent.

* * * * *